US007164124B2

(12) United States Patent
Takada et al.

(10) Patent No.: US 7,164,124 B2
(45) Date of Patent: Jan. 16, 2007

(54) MASS SPECTROMETRIC APPARATUS AND ION SOURCE

(75) Inventors: Yasuaki Takada, Kiyose (JP); Hisashi Nagano, Hino (JP); Masao Suga, Hachioji (JP); Hideo Kashima, Kokubunji (JP); Izumi Waki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/009,485

(22) Filed: Dec. 13, 2004

(65) Prior Publication Data

US 2005/0199799 A1 Sep. 15, 2005

(30) Foreign Application Priority Data

Mar. 10, 2004 (JP) ..... 2004-066547

(51) Int. Cl.
*H01J 49/10* (2006.01)

(52) U.S. Cl. ..... 250/288; 250/423 R

(58) Field of Classification Search ..... 250/288, 250/289, 285, 423 R
See application file for complete search history.

(56) References Cited

U.S. PATENT DOCUMENTS 5,612,534 A 3/1997 Mimura et al.
6,544,484 B1 * 4/2003 Kaufman et al. ..... 422/186.04
6,649,907 B1 * 11/2003 Ebeling et al. ..... 250/288
6,686,592 B1 2/2004 Sakairi et al.
6,737,641 B1 5/2004 Kato

FOREIGN PATENT DOCUMENTS

| | | |
|---|---|---|
| JP | 2001-351569 | 6/2000 |
| JP | 2002-181783 | 12/2000 |
| WO | WO 99/13492 | 9/1998 |

* cited by examiner

*Primary Examiner*—Kiet T. Nguyen
(74) *Attorney, Agent, or Firm*—Reed Smith LLP; Stanley P. Fisher, Esq.; Juan Carlos A. Marquez, Esq.

(57) ABSTRACT

A mass spectrometric apparatus capable of generating and detecting positive and negative ions stably at the same time. The apparatus preferably comprises: an opening through which a sample gas is introduced; an ion source to generate ions of the sample gas; and a mass spectrometer to analyze the mass of the generated ions. The ion source utilized with the mass spectrometric device comprises: a first needle electrode on which a voltage is applied in order to generate positive ions of the sample gas introduced through the opening; a first counter electrode having a first opening through which the sample gas and the positive ions pass; a second counter electrode disposed opposite the first counter electrode having a second opening through which the sample gas and the positive ions pass; a second needle electrode on which voltage is applied in order to generate negative ions of the sample gas; and a vent through which the sample gas is ejected. Generated ions are then introduced into a vacuum region via an aperture and subjected to mass analysis.

20 Claims, 9 Drawing Sheets

MASS SPECTROMETRIC APPARATUS AND ION SOURCE

CLAIM OF PRIORITY

The present application claims the benefit under 35 U.S.C. § 119 of the earlier filing date of Japanese Patent Application JP 2004-066547 which was filed on Mar. 10, 2004, the content of which is hereby incorporated by reference into the present application.

BACKGROUND OF THE INVENTION

1. Field of the Invention

The present invention relates to a mass spectrometric apparatus and more particularly to a technology to detect concealed explosives and illegal medicines using a mass spectrometric apparatus.

2. Description of the Background

As international disputes get more acute, a detector that can detect explosives is desired in order to prevent terrorism and maintain security. As such detectors, baggage inspection devices that make use of X-ray transmission are widely used, for example, at airports. A method that uses an X-ray detector or similar technology is known as "bulk detection" because an object is recognized as a bulk and a hazardous material is identified from the information such as the shape of the bulk.

In contrast, a detection method based on gas analysis is known as "trace detection," and an object is identified by the chemical analysis information. A feature of trace detection is that it is possible to detect a very minute amount of a component adhering to a bag or other object. Under circumstances in which higher security is socially demanded, a device that can detect hazardous materials with a higher degree of accuracy by the combined use of bulk detection and trace detection is desired.

At the same time, detectors are presently utilized at customs and similar places in order to find illegal medicines (e.g., narcotics, drugs, or unregulated medicine) that are brought in through various routes. At customs, bulk detectors and drug-sniffing dogs are mainly used, and a trace analyzer for illegal medicine detection that can replace drug-sniffing dogs is desired.

In trace detection, various analytical methods have been posited such as ion mobility spectroscopy, gas chromatography, and similar processes. The development of a device simultaneously having speed (high throughput), sensitivity, and selectivity (low false alarm rate), all features that are important for a detector, is desired and described herein.

Under these conditions, mass spectrometry has very good throughput, sensitivity, and selectivity. Therefore, detection technologies based on mass spectrometry have been proposed (e.g., Japanese Patent Application No. JP-A No. 134970/1995, hereafter "Patent Document 1").

FIG. 10 is a view explaining a detector of Patent Document 1 based on mass spectrometry. As shown in FIG. 10, an air introduction probe 1 is connected to an ion source 3 via an insulation pipe 2, and the ion source 3 is connected to an air suction pump 6 via a vent 4 and another insulation pipe 5. The ion source 3 is equipped with a needle electrode 7, a first aperture electrode 8, an intermediate pressure region 9, and a second aperture electrode 10. The needle electrode 7 is connected to a power supply 11, and the first and second aperture electrodes 8 and 10 are connected to an ion acceleration power supply 12. The intermediate pressure region 9 is connected to a vacuum pump via another vent 13.

An electrostatic lens 14 is disposed at the back of the intermediate pressure region 9 and a mass analysis portion 15 and a detector 16 are disposed at the back of the electrostatic lens 14.

Detection signals from the detector 16 are fed to a data processing portion 18 via an amplifier 17. The data processing portion 18 identifies a plurality m/z (mass of ion/valence of ion) values showing a specific medicine and determines whether or not the specific medicine is contained in a test gas. The data processing portion 18 is equipped with a mass judgment portion 101, a substance A judgment portion 102, a substance B judgment portion 103, a substance C judgment portion 104, and an alarm operation portion 105. Further, display portions 106, 107, and 108 are disposed on an alarm display 19 operated by the alarm operation portion 105.

In hazardous material detection based on mass spectrometry, ion sources particularly suitable for substances, such as explosives, that tend to be negatively ionized have been reported (e.g., Japanese Patent Application No. JP-A No. 93461/2001, hereafter "Patent Document 2"). FIG. 11 is a drawing showing an example of an ion source according to Patent Document 2 in a detector using mass spectrometry.

In FIG. 11, a sample introduced through a sample introduction tube 20 is then introduced into an ion drift region 21. Part of the sample introduced into the ion drift region 21 is introduced into a corona discharge portion 22 and the rest of the sample is ejected to the exterior of the ion source through a sample exhaust tube 23. The part of the sample introduced into the corona discharge portion 22 is fed into a corona discharge region 25 that is formed at the tip of a needle electrode 24 by imposing a high voltage and ionized. At that time, the sample is introduced from the direction nearly opposing the direction of the flow of ions drifting from the needle electrode 24 toward a counter electrode 26. The generated ions are introduced into the ion drift region 21 through the opening 27 of the counter electrode 26 by an electric field.

At this time, it is possible to make the ions drift and efficiently introduce them into a first aperture 28 by imposing a voltage between the counter electrode 26 and the first aperture 28. The ions introduced through the first aperture 28 pass through a second aperture 29 and a third aperture 30 where they are analyzed with a mass spectrometer (not shown in the figure) disposed at a vacuum region 31.

The flow rate of the sample introduced into a corona discharge region 25 is important for a stable ionization and therefore a suction tube 32 and a flow controller 33 are connected to the corona discharge portion 22. The rate of flow passing through the sample exhaust tube 23 and the suction tube 32 is determined by the flow controller 33, the capacity of a suction pump 34, and the conductance of various tubes including the sample introduction tube 20.

Similarly, the following technologies related to mass spectrometry are known in the art:

(1) Providing two needle electrodes for an ion source and discharging ions with the polarities of two needle electrodes being different from each other, one being positive and the other being negative (Japanese Patent Application No. JP-C No. 516140/2001, hereafter "Patent Document 3");

(2) Providing two mass spectrometers side-by-side, physically separating (i.e., ramifying) a sample gas into two portions, introducing each of the separated sample gas portions into the two mass spectrometers, and measuring positive ions with one of the mass spectrometers and negative ions with the other mass spectrometer (Japanese Patent Application No. JP-A No. 236582/1997, hereafter "Patent Document 4");

(3) Disposing two needle electrodes to an ion source, one at a position suitable for positive ionization and the other at a position suitable for negative ionization, and switching the ionizing polarity, wherein a positive high voltage is applied on both of the needle electrodes in the event of positive ion measurement and a negative high voltage is applied on both of the needle electrodes in the event of negative ion measurement (Japanese Patent Application No. JP-A No. 181783/2002, hereafter "Patent Document 5");

(4) An ion source having a plurality of needle electrodes (Japanese Patent Application No. JP-A No. 351569/2001, hereafter "Patent Document 6"); and (5) Providing two ion sources for corona discharging and electrostatic spraying, generating ions having polarities different from each other, introducing the ions having each polarity into an identical vacuum region through each aperture, and blending the positive and negative ions in the vacuum region (Japanese Patent Application No. JP-A No. 242926/2003, hereafter "Patent Document 7").

In the method of using corona discharge, known as the "atmospheric pressure chemical ionization method," there are two types: (1) a mode of generating positive ions; and (2) a mode of generating negative ions. The appropriate mode depends upon the object to be measured. For example, since most illegal medicines such as narcotics and stimulant drugs have a high proton affinity in a vapor phase, they are highly efficient in generating proton-added positive pseudo molecular ions in the positive ionization mode. In contrast, in the case of nitro-compounds into which most explosives are classified, since they have a high electro-negativity, they are ionized with a high degree of efficiency in the negative ionization mode.

In the case of use in an airport, up to the present time, the object of security staff has been to detect explosives and the object of customs staff has been to find illegal medicines such as narcotics and stimulant drugs. That is, it has been well accepted to use the negative ionization mode for detection by security staff and to use the positive ionization mode for detection by customs staff, Either mode has been widely used depending on the users, locations of use, and status of use. However, in view of the recent social situation, the desire to simultaneously detect explosives and illegal medicines has intensified. For example, even at customs, the need to prevent smuggling of not only illegal medicines but also explosives that may possibly be used in domestic terror is increasing.

In the case of the detector according to Patent Document 1, since the positive ionization mode and the negative ionization mode are used alternately, it has been difficult to detect a substance suitable for the positive ionization mode and a substance suitable for the negative ionization mode simultaneously, with a high sensitivity.

In the case of an analyzer, for example a device made by directly connecting liquid chromatograph to a mass spectrometer, the time spent while a sample is transferred from the liquid chromatograph to the mass spectrometer is in the range of about one minute. Therefore, it is well within the capacity of measuring positive ions and negative ions substantially at the same time while the polarity of the ion source and the mass spectrometer is switched every few seconds. Nevertheless, when it is attempted to apply this method to the field of hazardous material detection, there arise several problems and the application is substantially difficult. The problems arise because, under some detection conditions, an object gas to be measured reaches an ion source only for a very short period of time, such as from 0.2 to 0.3 sec. To cope with that situation, it becomes necessary to measure an object gas while the polarity of discharge is reversed at a high speed, for example the polarity may be switched every 0.05 sec.

However, a challenge of the method has been that, when measurement is carried out while the polarity of high voltage applied on a needle electrode is switched at such a high speed, the corona discharge generated at the tip of the needle electrode is not sufficiently stabilized and the reproducibility of the detection result deteriorates. Further, there is a possibility that an electric current load of about 1 mA is instantaneously applied on a high voltage power supply in accordance with the high speed reversal of polarity. Moreover, when the polarity is reversed every 0.05 sec., the electric current load is incurred more than two million times even with 24 hour continuous operation of the device. Therefore, another problem has been that a high voltage power source that can withstand such shocks has not been developed, and especially not at a reasonable cost.

Furthermore, since dischargeability varies in accordance with the polarity imposed on a needle electrode, a problem arises that, when the tip of the needle electrode is damaged by discharge, discharge of either of the positive or negative polarity does not normally occur in some cases. Therefore frequent maintenance, such as to change of the needle electrode, is necessary and the timing of such is difficult to detect.

For the aforementioned reasons, a detector capable of simultaneously detecting illegal medicines that are compatible with positive ionization and explosives that are compatible with negative ionization has long been desired.

SUMMARY OF THE INVENTION

It is an object of the present invention to provide an ion source capable of stably generating positive and negative ions substantially at the same time and a mass spectrometric apparatus that uses the ion source. The present invention has addressed the aforementioned problems by using an ion source having a positive discharge portion and a negative discharge portion to generate both positive and negative ions from a sample gas substantially at the same time. A mass spectrometric apparatus according to the present invention, therefore, detects illegal medicines that are likely to positively ionize and explosives that are likely to negatively ionize substantially simultaneously with a high sensitivity using this ion source.

A mass spectrometric apparatus according to the present invention is equipped with: a vaporizing region to vaporize a sample; a gas introducing system to introduce a gas vaporized at the vaporizing region; an ion source that has two discharge portions and ionizes the components contained in the gas introduced from the gas introducing system; and a mass spectrometer to analyze the mass of ions generated at the ion source. The two discharge portions generate discharge of polarities electrically different from each other. A mass spectrometric apparatus according to the present invention makes it possible to detect a substance that is likely to positively ionize and a substance that is likely to negatively ionize substantially at the same time. A mass spectrometric apparatus according to the present invention is preferably applicable as a detector capable of detecting illegal medicines compatible with positive ion measurement and explosives compatible with negative ion measurement substantially at the same time.

One preferred mass spectrometric apparatus according to the present invention comprises an opening through which a sample gas is introduced, an ion source to generate ions of the introduced sample gas, and a mass spectrometer to analyze the mass of the ions generated at the ion source.

An ion source for use with the invention comprises: a positive corona discharge portion having a first needle electrode on which voltage is applied in order to generate positive ions of a sample gas introduced through an opening; a negative corona discharge portion having a second needle electrode on which voltage is applied in order to generate negative ions of the sample gas (optionally after having passed through the positive corona discharge portion); and a vent through which the sample gas having passed through the negative corona discharge portion is ejected. The sample gas introduced through the opening passes through the positive and negative corona discharge portions and is then ejected through the vent. An electrode that imposes a control voltage to select the polarity of ions to be detected by a mass spectrometer is also provided, and the polarity of the ions to be detected can thereby be selected.

An alternative ion source according to the present invention preferably comprises: a first needle electrode on which voltage is applied in order to generate positive ions of a sample gas introduced through an opening; a first counter electrode having a first opening through which the sample gas and the positive ions pass and being disposed opposite the tip of the first needle electrode; a second counter electrode disposed opposite the first counter electrode and having a second opening through which the sample gas and the positive ions pass; a second needle electrode, disposed opposite the second opening, on which voltage is applied in order to generate negative ions of the sample gas optionally after having passed through the second opening; and a vent through which the sample gas having passed through the second opening is ejected. The sample gas introduced through the opening passes through the tip of the first needle electrode, the first and second openings, and the tip of the second needle electrode and then is ejected through the vent.

In this embodiment, the ion source may be configured such that a straight line connecting the tip of the first needle electrode and the center of the first opening and a straight line connecting the center of the second opening and the tip of the second needle electrode are on the same line. Optionally, the ion source may be configured so that an angle formed between the straight line connecting the tip of the first needle electrode and the center of the first opening and the straight line connecting the center of the second opening and the tip of the second needle electrode is in the range of from 90 to 120 degrees.

Another ion source according to the present invention preferably comprises: a positive corona discharge portion having a first needle electrode on which voltage is applied in order to generate positive ions of a sample gas introduced through an opening; a negative corona discharge portion having a second needle electrode on which voltage is applied in order to generate negative ions of the sample gas introduced through the opening; a first vent through which the sample gas optionally after having passed through the positive corona discharge portion is ejected; and a second vent through which the sample gas having passed through the negative corona discharge portion is ejected. The opening through which the sample gas is introduced is disposed toward the space between the positive corona discharge portion and the negative corona discharge portion. The sample gas introduced through the opening passes through the positive corona discharge portion and is ejected through the first vent and also passes through the negative corona discharge portion and is ejected through the second vent.

Another ion source according to the present invention comprises: a first counter electrode having a first opening through which a sample gas introduced through an opening passes; a first needle electrode, being disposed opposite the first opening, on which voltage is applied in order to generate positive ions of the sample gas having passed through the first opening; a second counter electrode being disposed opposite the first counter electrode and having a second opening through which the sample gas passes; a second needle electrode, being disposed opposite the second opening, on which voltage is applied in order to generate negative ions of the sample gas having passed through the second opening; a first vent through which the sample gas having passed through the first opening is ejected; and a second vent through which the sample gas having passed through the second opening is ejected.

Again in this embodiment, a straight line connecting the tip of the first needle electrode and the center of the first opening and a straight line connecting the center of the second opening and the tip of the second needle electrode are on the same line, and the opening through which the sample gas is introduced is disposed toward the space between the first counter electrode and the second counter electrode. The sample gas introduced through the opening passes through the first opening and the tip of the first needle electrode and is ejected through the first vent, and also passes through the second opening and the tip of the second needle electrode and is ejected through the second vent.

The mass spectrometric method according to the present invention has the following features.

A method of performing mass spectrometry according to the present invention comprises the steps of: feeding a sample gas into a positive corona discharge portion; generating positive ions of the sample gas by corona discharge at the positive corona discharge portion; feeding the sample gas (optionally after having passed through the positive corona discharge portion) to a negative corona discharge portion; generating negative ions of the sample gas by corona discharge at the negative corona discharge portion; selecting the polarity of the ions to be subjected to mass analysis; applying mass analysis to the ions the polarity of which has been selected; and displaying the mass analysis result as a mass spectrum. The sample gas having passed through the negative corona discharge portion is ejected through a vent.

Utilizing a mass spectrometric apparatus according to the present invention, it is possible to generate positive ions and negative ions substantially simultaneously and stably. It therefore is possible to detect various kinds of object substances merely by switching the polarity of a mass spectrometer for the detection of ions substantially at the same time. Since it is not necessary to switch the polarity of ionization at an ion source, the easier/reduced maintenance of the apparatus has been facilitated, for example, the load on a high voltage power supply has been decreased and the service lives of the needle electrodes of the discharge portions have thereby been extended.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

Figure 1:
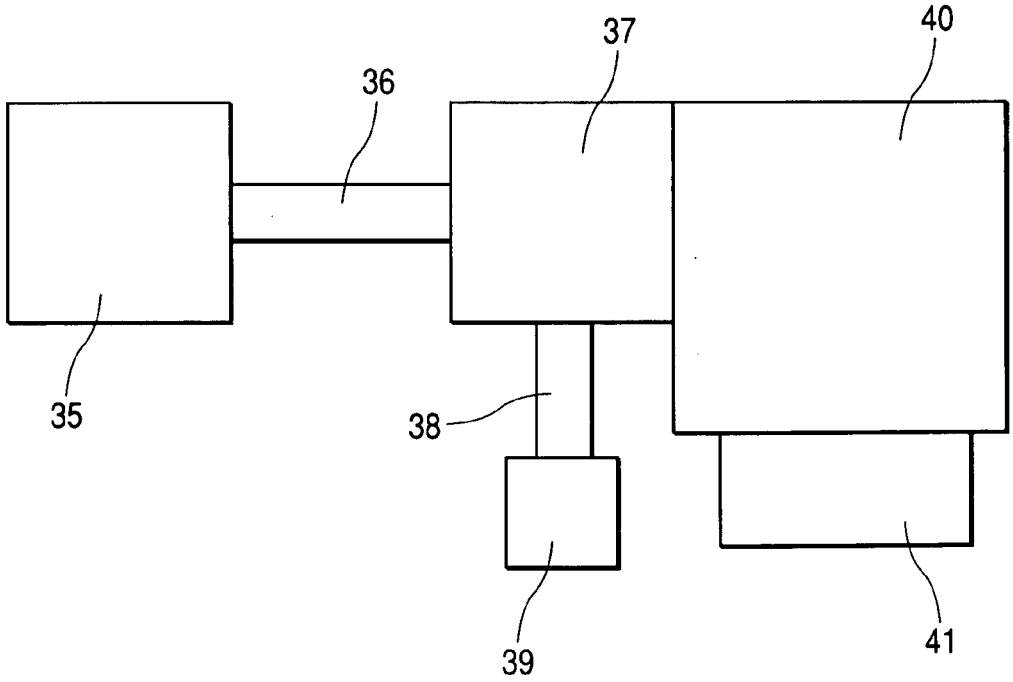
FIG. 1 is a block diagram showing the configuration of a mass spectrometric apparatus in an embodiment according to the present invention.

Initially, the general features of an ion source configuration used in a mass spectrometric apparatus according to the present invention are explained hereunder. Thereafter, specific exemplary embodiments will be set forth in detail.

An ion source according to the present invention comprises: an opening through which a sample gas is introduced; a positive corona discharge portion having a first needle electrode on which voltage is applied in order to generate positive ions of the sample gas introduced through the opening; a negative corona discharge portion having a second needle electrode on which voltage is applied in order to generate negative ions of the sample gas (optionally after having passed through the positive corona discharge portion); and a vent through which the sample gas having passed through the negative corona discharge portion is ejected. The sample gas introduced through the opening passes through the positive and negative corona discharge portions and then is ejected through the vent.

To explain the ion source more precisely, the ion source comprises: an opening through which a sample gas is introduced; a first needle electrode on which voltage is applied in order to generate positive ions of the sample gas introduced through the opening; a first counter electrode having a first opening through which the sample gas and the positive ions pass and being disposed opposite the tip of the first needle electrode; a second counter electrode being disposed opposite the first counter electrode and having a second opening through which the sample gas and the positive ions pass; a second needle electrode, being disposed opposite the second opening, on which voltage is applied in order to generate negative ions of the sample gas having passed through the second opening; and a vent through which the sample gas having passed through the second opening is ejected. The sample gas introduced through the opening passes through the tip of the first needle electrode, the first and second openings, and the tip of the second needle electrode and then is ejected through the vent.

The ion source is preferably configured so that a straight line connecting the tip of the first needle electrode and the center of the first opening and a straight line connecting the center of the second opening and the tip of the second needle electrode are on the same line (are collinear). Alternatively, the ion source may be configured so that an angle formed between the straight line connecting the tip of the first needle electrode and the center of the first opening and the straight line connecting the center of the second opening and the tip of the second needle electrode is in the range from about 90 to about 120 degrees.

An ion source of another configuration according to the present invention comprises: an opening through which a sample gas is introduced; a positive corona discharge portion having a first needle electrode on which voltage is applied in order to generate positive ions of the sample gas introduced through the opening; a negative corona discharge portion having a second needle electrode on which voltage is applied in order to generate negative ions of the sample gas introduced through the opening; a first vent through which the sample gas having passed through the positive corona discharge portion is ejected; and a second vent through which the sample gas having passed through the negative corona discharge portion is ejected. The opening through which the sample gas is introduced is disposed toward the space between the positive corona discharge portion and the negative corona discharge portion. The sample gas introduced through the opening passes through the positive corona discharge portion and is ejected through the first vent, and then passes through the negative corona discharge portion and is ejected through the second vent.

To explain the ion source of this embodiment more precisely, the ion source comprises: an opening through which a sample gas is introduced; a first counter electrode having a first opening through which the sample gas introduced through the opening passes; a first needle electrode, being disposed opposite the first opening, on which voltage is applied in order to generate positive ions of the sample gas having passed through the first opening; a second counter electrode being disposed opposite the first counter electrode and having a second opening through which the sample gas passes; a second needle electrode, being disposed opposite the second opening, on which voltage is applied in order to generate negative ions of the sample gas having passed through the second opening; a first vent through which the sample gas having passed through the first opening is ejected; and a second vent through which the sample gas having passed through the second opening is ejected.

A straight line connecting the tip of the first needle electrode and the center of the first opening and a straight line connecting the center of the second opening and the tip of the second needle electrode are on the same line (collinear). The opening through which the sample gas is introduced is disposed toward the space between the first counter electrode and the second counter electrode. The sample gas introduced through the opening passes through the first opening and the tip of the first needle electrode and is ejected through the first vent, and also passes through the second opening and the tip of the second needle electrode and is ejected through the second vent.

Specific embodiments according to the present invention are hereunder explained in detail by using the figures. FIG. 1 is a block diagram showing the configuration of a mass spectrometric apparatus in an exemplary embodiment according to the present invention.

A wiper with which the surface of a test object such as luggage is cleaned up is put into a heating unit 35. Chemical substances adhering to the wiper are heated at the heating unit 35 and vaporized. The gas generated in the heating unit 35 is fed to an ion source 37 via an introduction tube 36. In order to prevent adsorption, it is desirable that the introduction tube 36 is also heated. A portion of the components in the gas is ionized at the ion source 37, but most of the gas is sucked by a suction pump 39 via a suction tube 38. The ions generated at the ion source 37 are introduced into a mass analysis portion 40 disposed in the vacuum formed by the ejection with a vacuum pump 41 and are subjected to mass analysis.

Figure 2:
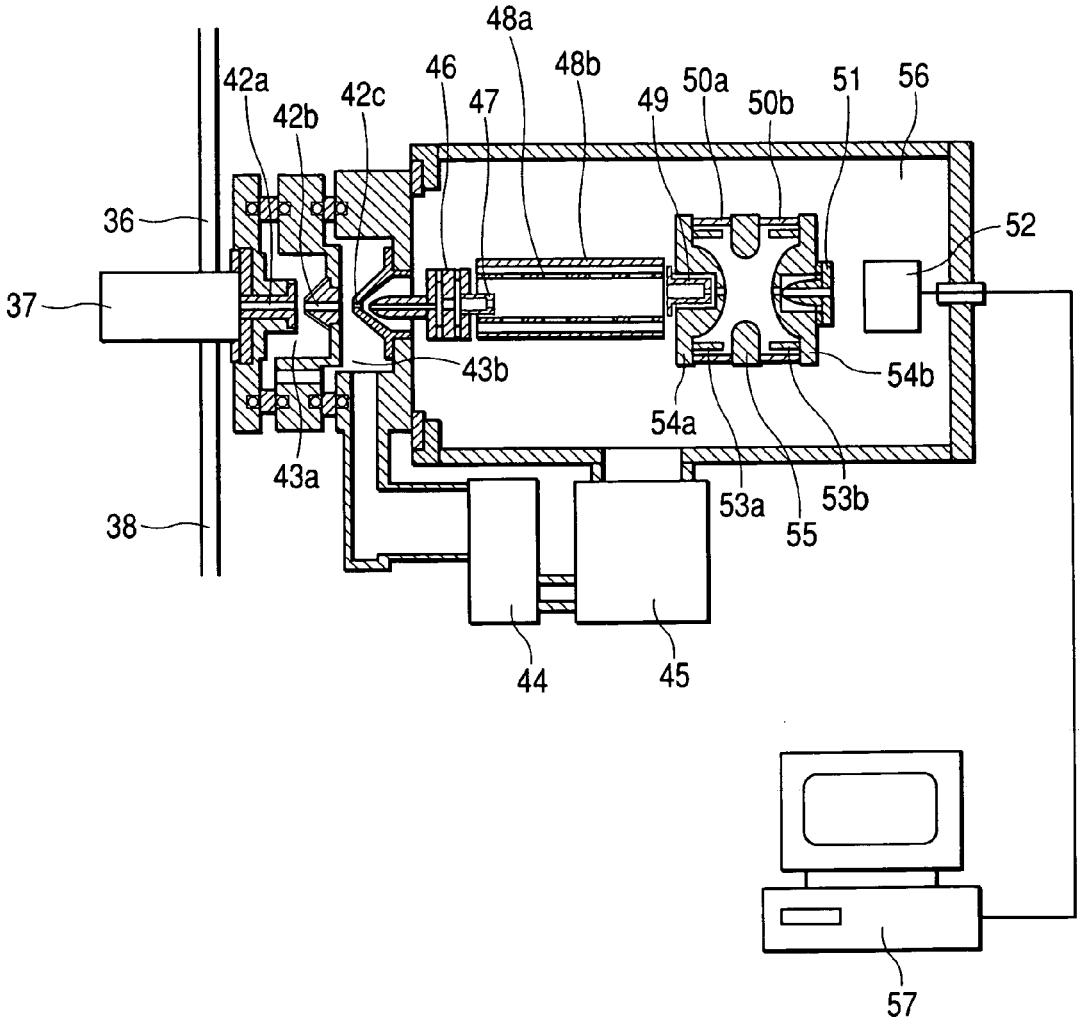
FIG. 2 is a view of a mass spectrometric apparatus using a quadrupole ion trap mass spectrometer.

FIG. 2 is a view explaining the structure of a mass spectrometric apparatus using a quadrupole ion trap mass spectrometer in an embodiment according to the present invention.

Ions generated at an ion source 37 are introduced into a vacuum region 56 via apertures 42*a*, 42*b*, and 42*c* and intermediate pressure regions 43*a* and 43*b*. A heater (not shown in the figure) is attached to each of the electrodes having the apertures 42*a*, 42*b*, and 42*c* and heats each electrode in order to mitigate so-called "clustering"—a phenomenon of a gas undergoing adiabatic expansion when it is introduced into the vacuum region 56 and water vapor molecules adhering to ions. Further, a "drift voltage" is applied on each of the electrodes having the apertures 42*a*, 42*b*, and 42*c* by a power source (not shown). The drift voltage has the effect of reducing the number of cluster ions by collision at the intermediate pressure regions 43*a* and 43*b* and improving the efficiency of ions passing through the apertures 42*b* and 42*c* by making the ions drift.

The ejection at the vacuum region 56 is borne by a turbo molecular pump 45. The ejection of the intermediate pressure regions 43*a* and 43*b* and the back pressure side of the turbo molecular pump 45 is borne by a mechanical pump 44 which includes a rotary pump. The ions introduced into the vacuum region 56 are focused by an ion guide comprising an electrostatic lens 46 and ion guide electrodes 48*a* and 48*b*. Thereafter the ions are introduced into a quadrupole ion trap mass spectrometer comprising endcap electrodes 54*a* and 54*b* and a ring electrode 55.

In order to prevent charged liquid droplets or similar impurities from reaching the detector and causing noise during detection, the center axis of the aperture 42*c* and the center axis of the opening of the endcap electrode 54*a* are preferably offset from each other. Further, a slit 47 is provided at a part of the electrostatic lens 46 in order to restrict the passage of ions, liquid droplets, and similar unwanted materials.

The timing of the injection of ions to and the ejection of the ions from the mass spectrometer is controlled by a voltage applied on a gate electrode 49 and a stop electrode 51. Since the electrostatic charge of the quartz rings 50*a* and 50*b* used for holding the endcap electrodes 54*a* and 54*b* and the ring electrode 55 influences the precision of the analysis, shield electrodes 53*a* and 53*b* are disposed in order to prevent ions from reaching the quartz rings 50*a* and 50*b*. The ions subjected to mass analysis are detected by an ion detector 52, and the signals are sent to a data processing portion 57 where the signals are processed. The operation of a quadrupole ion trap mass spectrometer is known well and no further explanation is necessary here.

Figure 3:
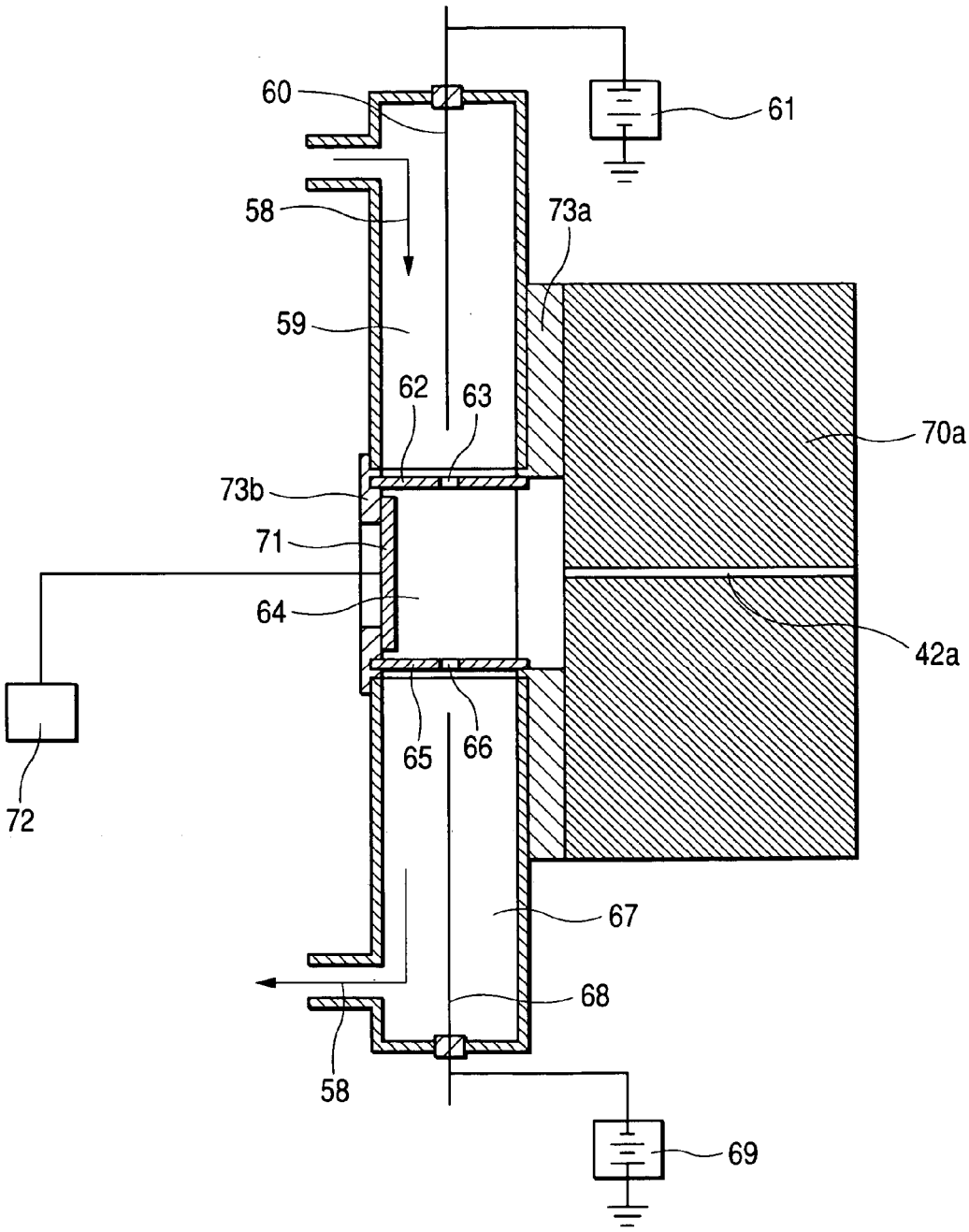
FIG. 3 shows an example of an ion source according to the present invention.

FIG. 3 shows an exemplary ion source in an embodiment according to the present invention. In FIG. 3, a gas 58 containing sample molecules initially flows into a discharge portion 59 (positive corona discharge portion) that generates positive corona discharge. The discharge portion 59 is equipped with a needle electrode 60, and a positive high voltage is applied thereon by a high voltage power supply 61. A voltage is also applied on an extraction electrode 62 by another power supply (not shown). Therefore, positive corona discharge occurs in the vicinity of the tip of the needle electrode 60 by the voltage potential difference between the needle electrode 60 and the extraction electrode 62.

When the atmospheric air is sucked into the discharge portion 59, hydronium ions ($H_3O^+$) and hydrated cluster ions ($(H_2O)_nH_3O^+$) thereof are produced by positive corona discharge. When the proton affinity of the sample molecules contained in the gas 58 is strong, a reaction wherein protons shift from the hydronium ions to the sample molecules occurs, and proton-added pseudo-molecular ions of the sample molecules are generated. The following Equation (C1) shows a typical positive ionization reaction wherein M represents sample molecules:

$$M+H_3O^+ \rightarrow (M+H)^+ + H_2O \quad \text{(C1)}$$

The positive ions generated in this way at the discharge portion 59 (positive corona discharge portion) are extracted toward the extraction electrode 62 by the voltage potential difference between the needle electrode 60 and the extraction electrode 62 and are then introduced through an opening 63 in the extraction electrode 62 into an ion drift region 64.

The gas 58 having drifted into the discharge portion 59 flows into a discharge portion 67 (negative corona discharge portion) via the opening 63 at the extraction electrode 62, the ion drift region 64, and an opening 66 at an extraction electrode 65, and is ejected therefrom (58). By so doing, the sample molecules having a low proton affinity are not positively ionized at the discharge portion 59 and reach the discharge portion 67.

The discharge portion 67 is equipped with a needle electrode 68 and a negative high voltage is applied to the needle electrode 68 by a high voltage power supply 69. A voltage is also applied on the extraction electrode 65 by a power supply (not shown). Therefore, negative corona discharge occurs in the vicinity of the tip of the needle electrode 68 by the voltage potential difference between the needle electrode 68 and the extraction electrode 65.

When the atmospheric air is sucked into the discharge portion 67, oxygen molecular ions ($O_2^-$) and hydrated cluster ions ($(H_2O)_nO_2^-$) thereof are produced by negative corona discharge. When the electronegativity of the sample molecules contained in the gas 58 is high, the sample molecules are ionized by ion molecule reaction with the oxygen molecular ions. The following Equation (C2) shows a typical negative ionization reaction wherein M represents sample molecules:

$$M+O_2^- \rightarrow M^- + O_2 \quad \text{(C2)}$$

The negative ions generated in this way at the discharge portion 67 (negative corona discharge portion) are extracted toward the extraction electrode 65 by the voltage potential difference between the needle electrode 68 and the extraction electrode 65. They are then introduced through the opening 66 at the extraction electrode 65 into the ion drift region 64.

In the configuration shown in FIG. 3, both positive ions generated at the discharge portion 59 and negative ions generated at the discharge portion 67 are introduced into the ion drift region 64 in relation to the voltage potential difference of each electrode. At the ion drift region 64, the positive ions drift from the opening 63 toward the extraction electrode 65 and the negative ions drift from the opening 66 toward the extraction electrode 62. Therefore, parts of the positive ions and negative ions are introduced into a vacuum region through an aperture 42*a* provided at an aperture electrode 70*a* and are subjected to mass analysis.

As shown in FIG. 3, in order to increase the amount of ions introduced through the aperture 42*a,* it is preferable to drift toward the aperture electrode 70*a* ions having a preselected polarity among the ions introduced into the ion drift region 64. This is accomplished by disposing a repeller electrode 71 opposite the aperture electrode 70*a* and switching the voltage applied on the repeller electrode 71 with a repeller voltage power supply 72.

As shown in FIG. 3, the mutual relation of the positions of the discharge portions 59 and 67, the extraction electrodes 65 and 62, and the aperture electrode 70*a* is maintained by a holder 73*a* formed by an insulator. Likewise, the mutual relation of the positions of the discharge portions 59 and 67, the extraction electrodes 65 and 62, and the repeller electrode 71 is maintained by a holder 73*b* formed by an insulator.

In FIG. 3, at the discharge portion 59 that generates positive ions, the gas 58 flows from the tip of the needle electrode 60 toward the extraction electrode 62. That is, the directions of the flow of the gas 58 and the drift of the positive ions are identical. This way of feeding the gas 58 is hereunder referred to as "fair flow." By adopting fair flow as the way of feeding the gas 58, ions are conveyed by not only an electric field but also gas flow, and therefore it is possible to increase the amount of ions introduced into the ion drift region 64 via the opening 63.

In contrast, at the discharge portion 67 that generates negative ions, it is configured such that the gas 58 is blown from the opening 66 toward the tip of the needle electrode 68 and thus the direction of the flow of the gas 58 is opposite the direction of the drift of the negative ions. This way of feeding the gas 58 is hereunder referred to as "counter flow."

At the discharge portion 67, when negative corona discharge is activated, oxygen molecular ions having the effect of ionizing the sample molecules are obtained as described by Equation (C2). At the same time, neutral nitrogen monoxide molecules (NO) formed by the reaction between nitrogen and oxygen in the atmospheric air are also generated. The nitrogen monoxide molecules easily react with oxygen molecular ions as follows:

$$NO+O_2^- \rightarrow NO_3^- \quad \text{(C3)}$$

$NO_3^-$ generated under the reaction of Equation (C3) is a stable ion and it does not contribute to the ionization of the sample molecules except for a part of the sample molecules. Therefore, when nitrogen monoxide molecules generated by discharge exist in abundance, the oxygen molecular ions that contribute to the ionization reaction decrease and the ionization efficiency of the sample molecules decreases.

Since corona discharge occurs in the vicinity of the tip of the needle electrode 68, oxygen molecular ions and nitrogen monoxide molecules are also generated in the vicinity of the tip of the needle electrode 68. When the gas 58 is introduced into the discharge portion 67 in the form of counter flow, whereas the oxygen molecular ions drift toward the extraction electrode 65 by an electric field, the neutral nitrogen monoxide molecules move toward the direction opposite the extraction electrode 65 by gas flow. Therefore, in the case of the counter flow, the oxygen molecular ions and the nitrogen monoxide molecules are conveniently separated from each other. It becomes possible to restrain the reaction of Equation (C3), and the amount of oxygen molecular ions generated under Equation (C2) is kept sufficient and the ionization efficiency of the sample molecules improves.

As a consequence, at the discharge portion 67 that bears negative corona discharge, as a result of comparing the effect of efficiently introducing ions into the ion drift region 64 by fair flow and the effect of removing unnecessary neutral molecules by counter flow and increasing the ionization efficiency of sample molecules, it has been found that the counter flow is able to increase the sensitivity of the apparatus to a greater degree.

As mentioned above, the features of fair flow and counter flow in ionization have been assessed, and the configuration has been determined such that a gas flows into a negative ionization portion via a positive ionization portion at the time of gas introduction. By so doing, even a configuration having two ionization portions and generating positive ions and negative ions at the respective ionization portions requires only a simple piping system.

In the case of constructing a piping system to physically separate a sample gas and introduce it into each ionization portion, it is necessary, for example, to use a three way valve or similar device in order to physically separate (ramify) the sample gas. It is preferable to heat the pipe system for the purpose of preventing the adsorption of sample molecules. However, it is difficult to uniformly heat a three way valve and a portion locally having a lower temperature than the surrounding area, called a cold spot, is likely to appear. A problem with the cold spot is that substances having a low vapor pressure and being likely to vaporize are adsorbed and remain. Therefore, problems occur such as the case where, when a next test sample is subjected to test, a substance having already been adsorbed is de-adsorbed and detected, causing false information.

In the case of the ion source shown in FIG. 3, both positive ions and negative ions coexist in the ion drift region 64. Those positive and negative ions are commonly introduced into the vacuum region through the aperture 42*a* provided at the aperture electrode 70*a* and the polarity of ions to be measured is selected at the mass spectrometric apparatus shown in FIG. 2.

That is, between the case where positive ions are measured and the case where negative ions are measured, it is necessary to oppositely switch the polarity of: (1) the drift voltage applied on the electrodes having the apertures 42*a,* 42*b,* and 42*c;* (2) the voltage applied on the electrostatic lens 46 used for focusing and transporting ions and the ion guide electrodes 48*a* and 48*b;* (3) the voltage applied on the gate electrode 49 and the stop electrode 51 in order to control the injection of ions to and the ejection thereof from the mass spectrometer; and (4) the voltage applied on the ion detector 52 in order to detect ions (refer to FIG. 2).

Illegal medicines that are likely to ionize positively and explosives that are likely to ionize negatively are detected substantially at the same time by generating positive ions and negative ions substantially at the same time at the ion source 37 and alternately switching between the voltage setting for positive ion measurement and the voltage setting for negative ion measurement at the mass analysis portion 40 (FIG. 1).

Further, at the ion drift region 64, when positive ions and negative ions react with each other and undesirable reactions such as the recombination of electric charge occurs, it is effective to provide a repeller electrode 71 and switch the polarity of voltage applied on the repeller electrode 71 in synchronization with the switching of the polarity of the voltage at the mass analysis portion 40.

That is, in the state where the mass analysis portion 40 measures positive ions, when the electric potential of the repeller electrode 71 is raised higher than that of the aperture electrode 70*a*, positive ions coming from the opening 63 drift toward the aperture electrode 70*a* and negative ions coming from the opening 66 drift toward the repeller electrode 71. Therefore, the trajectories of the positive ions and the negative ions at the ion drift region 64 are separated and undesirable reaction between the positive ions and the negative ions can be prevented or limited. In contrast, in the state where the mass analysis portion 40 measures negative ions, the electric potential of the repeller electrode 71 is decreased below that of the aperture electrode 70*a*.

Figure 4:
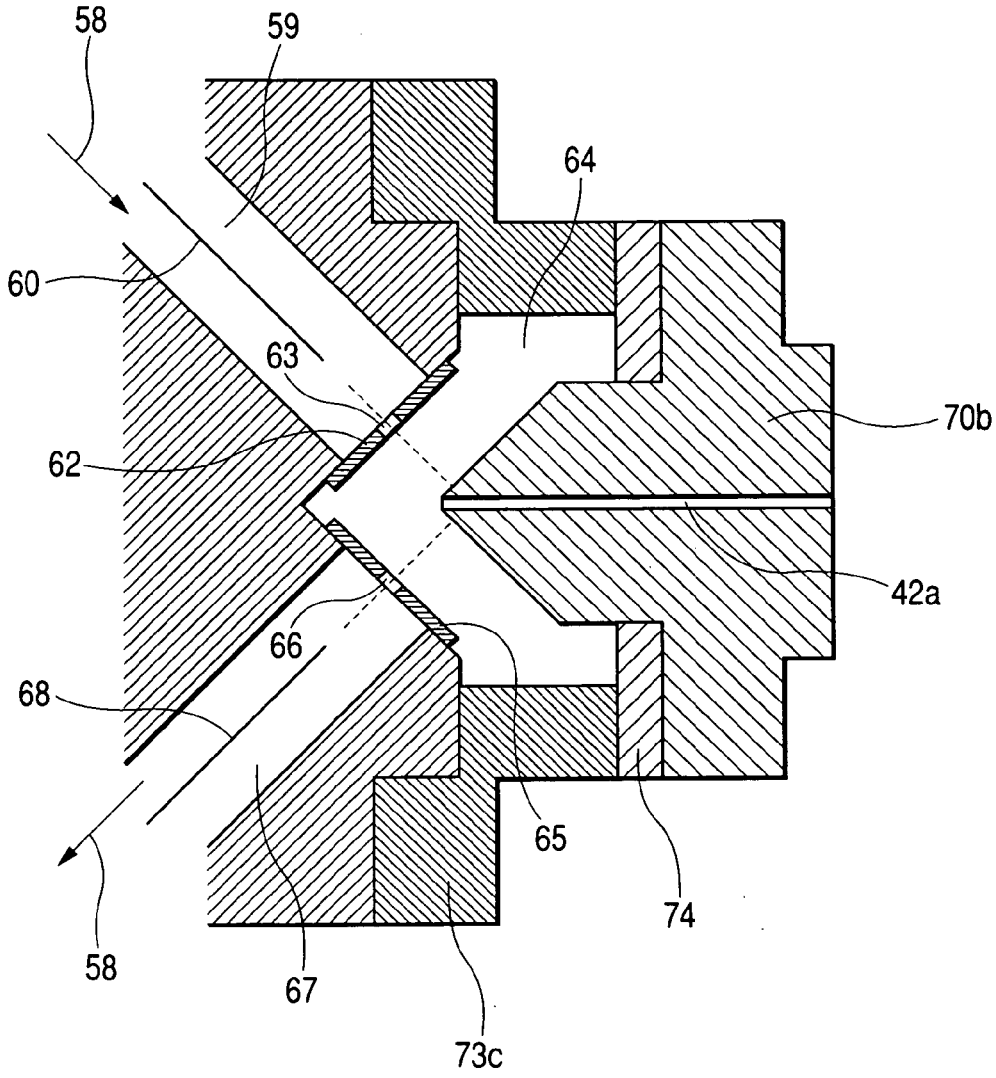
FIG. 4 shows another example of an ion source according to the present invention.

FIG. 4 is a view showing an example of another ion source in an additional embodiment according to the present invention. FIG. 4 shows a structure of an ion source that is simplified by eliminating the repeller electrode 71 and the repeller voltage power supply 72 from the structure of the ion source shown in FIG. 3. This structure is suitable for downsizing the ion source portion.

A gas 58 containing sample molecules initially flows into a discharge portion 59 (positive corona discharge portion) that generates positive corona discharge. The discharge portion 59 is equipped with a needle electrode 60, and a positive high voltage is applied thereon. A voltage is also applied on an extraction electrode 62 by a power supply. Therefore positive corona discharge occurs in the vicinity of the tip of the needle electrode 60 by the voltage potential difference between the needle electrode 60 and the extraction electrode 62. The positive ions of the sample molecules generated at the discharge portion 59 are extracted toward the extraction electrode 62 by the voltage potential difference between the needle electrode 60 and the extraction electrode 62 and are introduced through an opening 63 at the extraction electrode 62 into an ion drift region 64.

The gas 58 having drifted into the discharge portion 59 flows into a discharge portion 67 (negative corona discharge portion) via the opening 63 at the extraction electrode 62, the ion drift region 64, and an opening 66 at an extraction electrode 65, and is ejected. The discharge portion 67 is equipped with a needle electrode 68 and a negative high voltage is applied thereon. A voltage is also applied on the extraction electrode 65. Therefore, negative corona discharge occurs in the vicinity of the tip of the needle electrode 68 by the voltage potential difference between the needle electrode 68 and the extraction electrode 65.

The negative ions generated at the discharge portion 67 are extracted toward the extraction electrode 65 by the voltage potential difference between the needle electrode 68 and the extraction electrode 65 and are introduced through the opening 66 at the extraction electrode 65 into the ion drift region 64. An electric field is focused on the tip of the aperture 42*a* by tapering the aperture electrode 70*b* toward the opening of the aperture 42*a*. By controlling the angle formed between the needle electrodes 60 and 68 (or the angle formed by the respective electrode plates of the extraction electrodes 62 and 65) to approximately 90 to 120 degrees, the overall configuration can be downsized in comparison with the ion source shown in FIG. 3.

Ions introduced into the ion drift region 64 drift toward the aperture electrode 70*b* by the voltage potential difference between the extraction electrodes 62 and 65 and the aperture electrode 70*b* and are taken in through the aperture 42*a*. At that time, since the ions also drift based on the voltage potential difference between the extraction electrodes 62 and 65, in order to improve the efficiency of introducing the ions into the aperture 42*a*, it is preferable to locate the opening at the tip of the aperture 42*a* somewhat nearer to the extraction electrodes 62 and 65 than the intersection of the center lines (shown by the broken lines in FIG. 4) of the openings 63 and 66 of the extraction electrodes 62 and 65. Moreover, it is preferable to dispose a heater 74 in order to heat the aperture electrode 70*b*.

As shown in FIG. 4, the mutual relationship of the positions of the discharge portions 59 and 67, the extraction electrodes 65 and 62, and the aperture electrode 70 equipped with the heater 74 is maintained by a holder 73*c* formed by an insulator. That is, the mutual relationship of the positions of the opening at the tip of the aperture 42*a* and the centers of the openings 63 and 66 of the extraction electrodes 62 and 65 is maintained by the holder 73*c*.

The results of studying preferable detection conditions with regard to the ion source shown in FIG. 4 are now explained. As a result of an experiment, a positive result was obtained when the flow rate of the gas containing sample molecules was about 0.5 to 1.0 liter per min.

Figure 5:
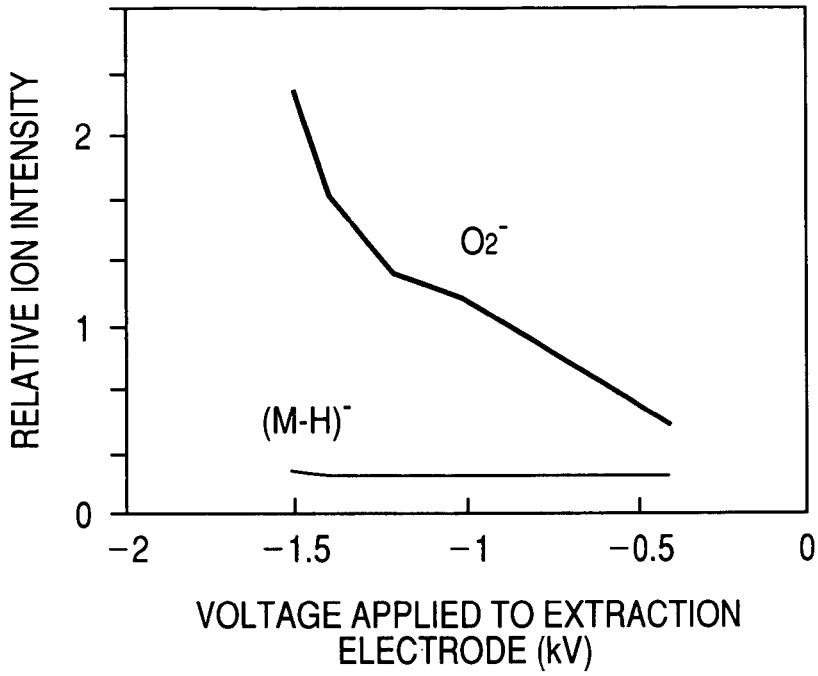
FIG. 5 is a graph showing the relationship between the voltage applied to the extraction electrode and the ion intensity.

FIG. 5 is a graph showing the relationship between the voltage applied to the extraction electrode and the ion intensity in an embodiment according to the present invention. FIG. 5 is the result obtained by setting the voltage potential difference between the needle electrode 68 and the extraction electrode 65 at 2 kV, varying the electric potential (kV) of the extraction electrode 65, and investigating the intensity of the negative ions (relative ion intensity) observed with a mass spectrometer. In this experiment, since the object of the experiment was to determine the state of the drift of the ions at the ion drift region 64, a voltage which was the same as the extraction electrode 65 in absolute value but opposite to it in polarity was applied on the extraction electrode 62 on the side of the positive ionization portion.

Trichlorophenol was used as a sample susceptible to negative ionization. Trichlorophenol is observed as an ion ($(M-H)^-$) formed by desorbing a proton from a molecule. The distance from the opening 66 to the tip of the aperture electrode 70*b* was set at about 8 mm. The electric potential of the aperture electrode 70*b* was set at −80 V, which was the set value at the time when negative ions were measured with a mass spectrometer.

As seen from the results shown in FIG. 5, the intensity of the oxide molecular ions varied widely in proportion to the voltage applied on the extraction electrode 65 (and the extraction electrode 62), but the intensity of the trichlorophenol molecular ions did not vary much in the voltage range from −0.5 to −1.0 kV. Presumably, this occurred because the gas flow is disturbed at the ion drift region 64 and the light oxygen molecular ions tend to be affected by the gas flow. Therefore, it is estimated that a higher electric field is necessary in order to efficiently extract the oxygen molecular ions toward the aperture electrode 70*b*. From this result, it was found that, since the molecular weights of explosives and illegal medicines which were the objects of detection were close to the molecular weight of trichlorophenol, a preferable range of the voltage applied on the extraction electrode was about ±1 kV in the case of detecting these sample molecules of about several hundreds in molecular weight.

Figure 6:
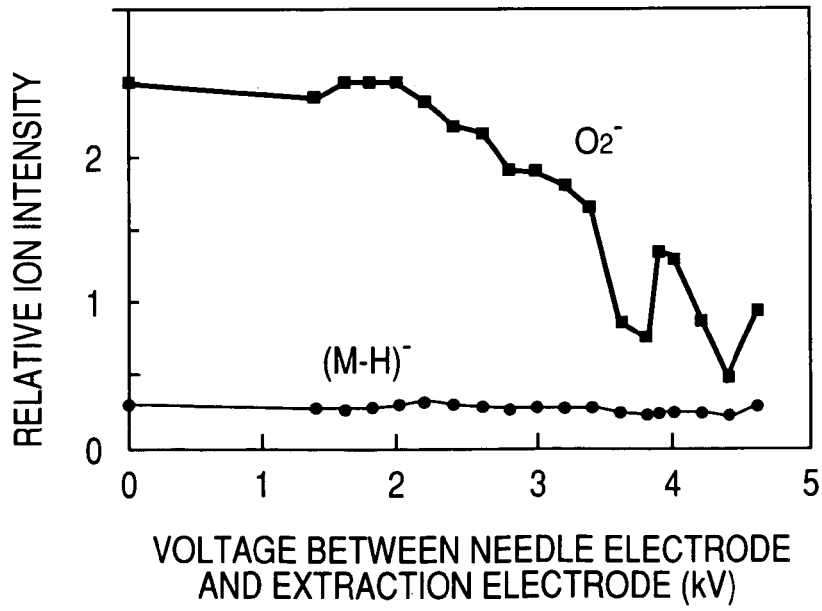
FIG. 6 is a graph showing the relationship between the voltage for discharge at the positive discharge portion and the negative ion intensity.

Next, the influence of reaction between ions having opposite polarities was investigated. FIG. 6 is a graph showing the relationship between the voltage for discharge at the positive discharge portion and the negative ion intensity in an embodiment according to the present invention.

FIG. 6 shows the result of the intensity (relative ion intensity) obtained by measuring the negative ions while the voltage potential difference between the needle electrode 68 and the extraction electrode 65 is set at 2 kV, the electric potential of the extraction electrode 65 is set at −1 kV (more specifically, that means the state of imposing +1 kV on the extraction electrode 62, −1 kV on the extraction electrode 65, and −3 kV on the needle electrode 68), and the electric potential (kV) between the needle electrode 60 and the extraction electrode (counter electrode) 62 is varied.

When the voltage potential difference exceeded 2 kV (namely, the electric potential of the needle electrode 60 exceeded +3 kV), positive corona discharge occurred at the discharge portion 59. When the voltage potential difference was further raised and the positive discharge current was increased, the intensity of oxygen molecular ions lowered. Presumably, this occurs because the positive ions (mainly $H_3O^+$) and oxygen molecular ions generated at the positive discharge portion 59 cause recombination reactions. On the other hand, it was clarified that, since the intensity of the negative ions ($(M-H)^-$) of trichlorophenol did not depend on the discharge state of the positive discharge portion, the negative ions of trichlorophenol did not react with the positive ions.

In the same way, positive ions were generated beforehand at the positive discharge portion 59 and the intensity of the positive ions observed with the mass spectrometer was investigated while varying the state of discharge at the negative discharge portion 67. Chloroacetophenone was used as a sample susceptible to positive ionization. As a result, it was found that the proton-added pseudo-molecular ions of chloroacetophenone observed as positive ions reacted with oxygen molecular ions and lost electric charge.

In this manner, since the negative ions of the sample were not affected by the positive ions but the positive ions of the sample were affected by the negative ions, it was found that, in order to generate the positive and negative ions substantially at the same time at the ion source shown in FIG. 4, the discharge current of the positive discharge portion 59 should be set larger than the discharge current of the negative discharge portion 67. Under this condition, since the number of positive ions exceeds that of the negative ions, even if some of the positive ions lost electric charge by the recombination with oxygen molecular ions, the remaining positive ions could still be detected.

Figure 7:
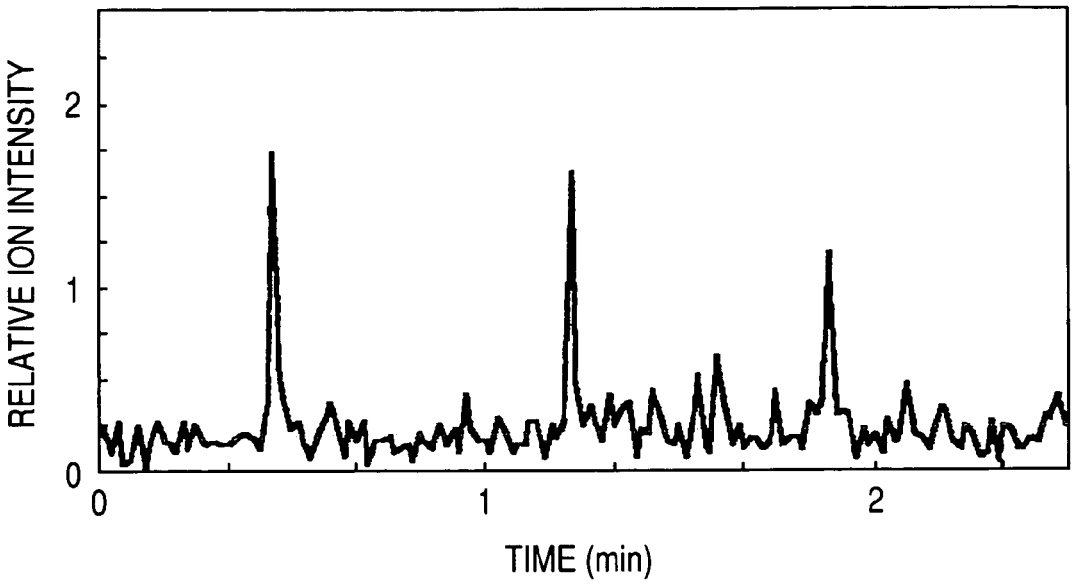
FIG. 7 is a graph showing an example of the detection of the negative ions of trinitrotoluene according to the present invention.
Figure 8:
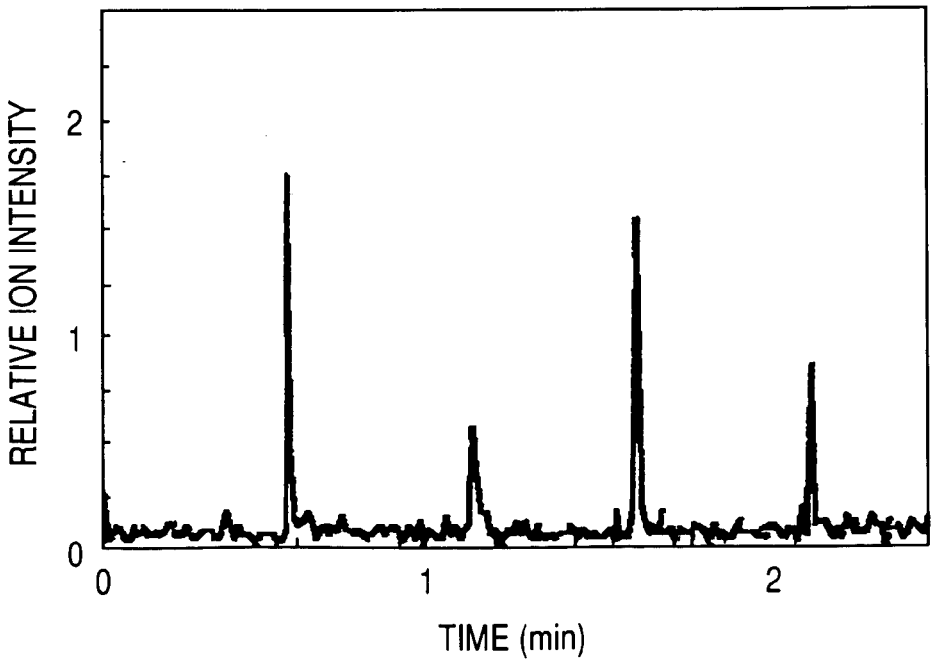
FIG. 8 is a graph showing an example of the detection of the positive ions of methamphetamine according to the present invention.

FIG. 7 is a graph showing an example of the detection of negative ions in an embodiment according to the present invention. Specifically, FIG. 7 is an example of the result of detecting trinitrotoluene, a kind of explosive, at the ion source shown in FIG. 4. FIG. 8 is a graph showing an example of the detection of positive ions in an embodiment according to the present invention. Specifically, FIG. 8 is an example of the result of detecting methamphetamine, a stimulant narcotic, at the ion source shown in FIG. 4.

In FIGS. 7 and 8, on the basis of the prior discussion and results, the discharge current at the positive discharge portion 59 is set at 6 microamperes and the discharge current at the negative discharge portion 67 is set at 3 microamperes. In FIGS. 7 and 8, the vertical line represents the relative ion intensity and the horizontal line represents the time.

FIG. 7 shows an example of the detection of molecular ions ($M^-$) in the case of using trinitrotoluene of 10 picograms. The sample was introduced three times and the relative ion intensity defined by the m/z value representing the observability of the ions of the trinitrotoluene increased at the timing of the sample introduction. The trinitrotoluene was thereby appropriately detected. Results showed that the detectable lower limit was about 1 picogram.

FIG. 8 shows an example of the detection of the proton-added pseudo-molecular ions ((M+H)+) in the case of using methamphetamine of 1 nanogram. The sample was introduced four times, and results showed that the detectable lower limit was about 30 picograms.

As has been explained with respect to FIGS. 3 and 4, by feeding the gas 58 in the state of fair flow at the positive discharge portion 59 and inversely in the state of counter flow at the negative discharge portion 67, it becomes possible to efficiently generate positive ions and negative ions together.

However, when maintenance and similar considerations are taken into consideration, the service life of a needle electrode, namely the time span wherein corona discharge is sustainable in a stable manner, tends to be longer in the case of counter flow than in the case of fair flow. Presumably, this occurs because, whereas the gas flow always hits the tip of the needle electrode in the case of counter flow, the respective flow at the tip of the needle electrode tends to stagnate and impurities tend to precipitate at the tip of the needle electrode in the case of fair flow. In this light, the configuration of the ion source in the case where a gas flows in the state of counter flow at both the positive and negative discharge portions with the aim of decreasing the frequency of maintenance such as the change of a needle electrode is hereunder explained by using FIG. 9.

Figure 9:
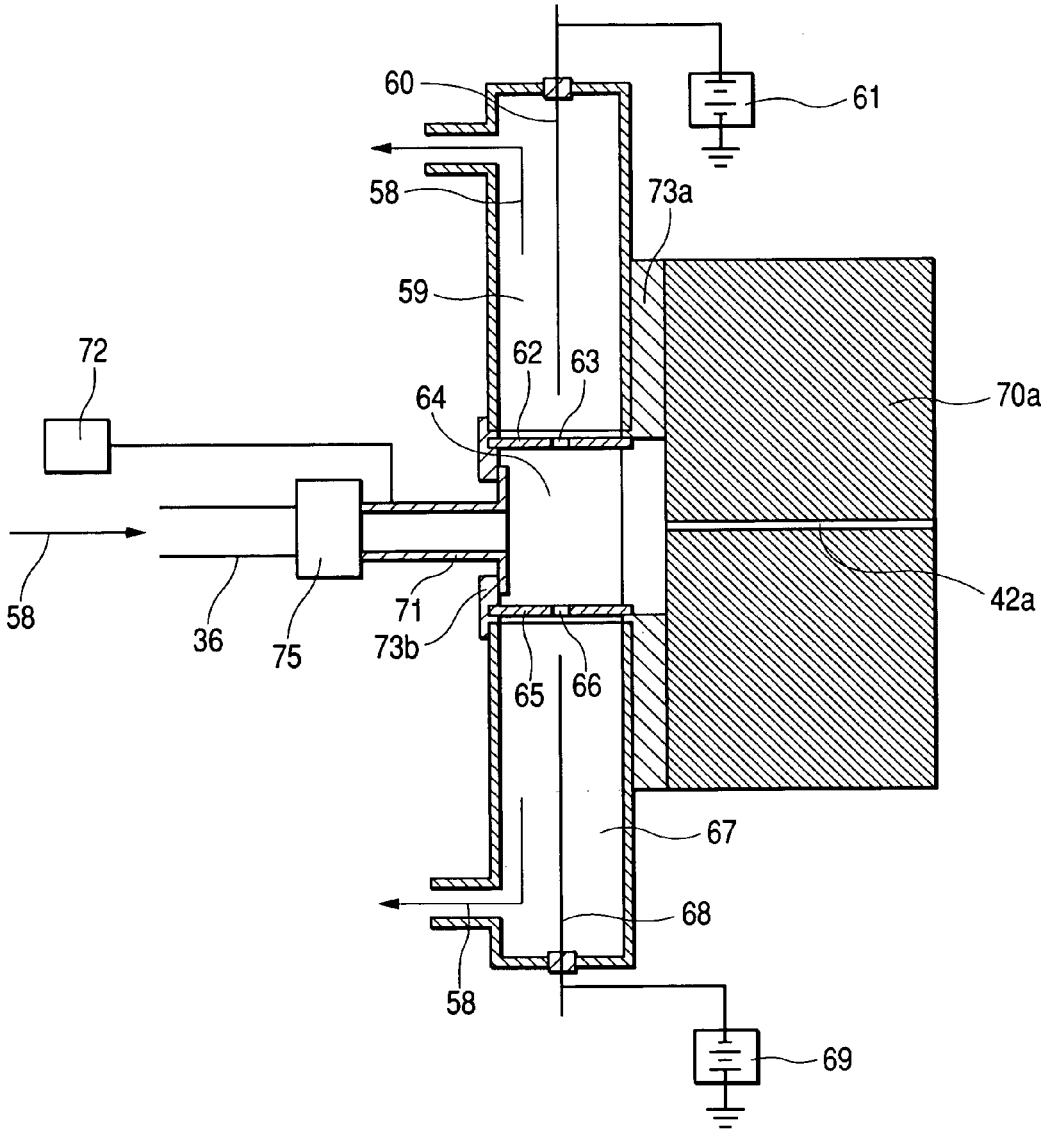
FIG. 9 shows an example of another ion source according to the present invention.
Figure 10:
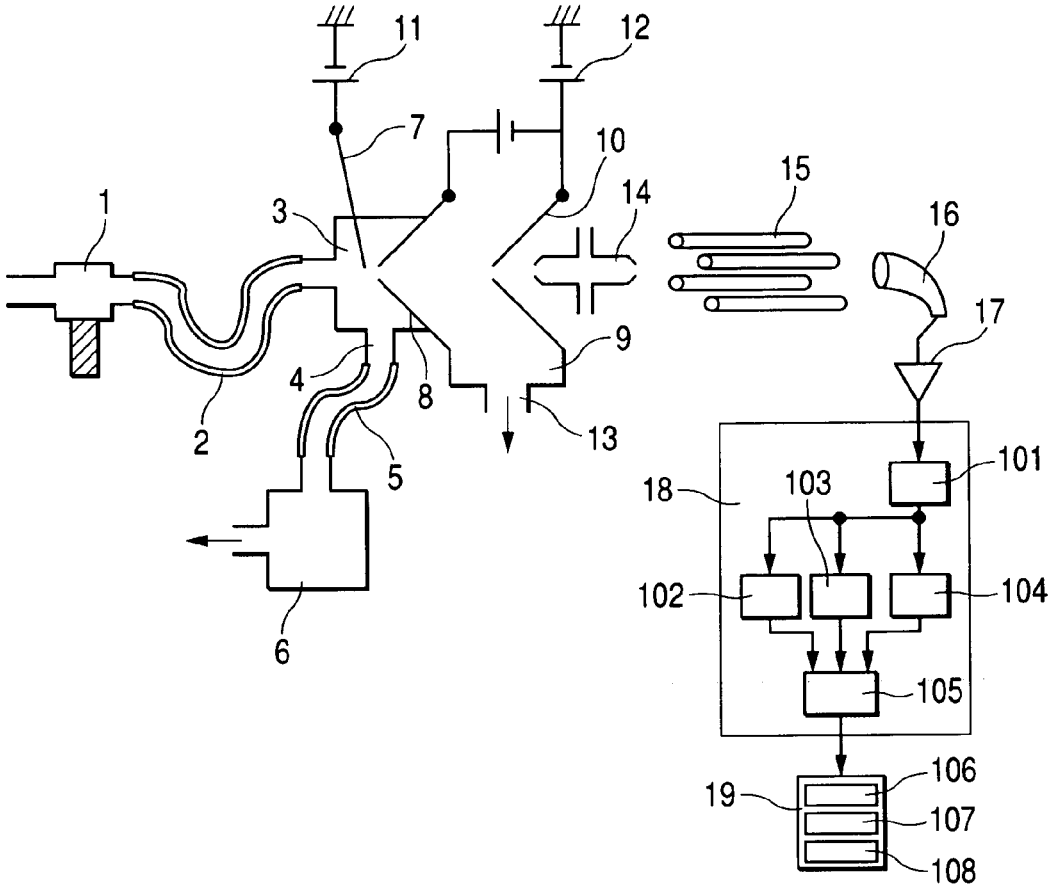
FIG. 10 PRIOR ART
FIG. 10 is a view of a conventional detector based on the mass analysis method.
Figure 11:
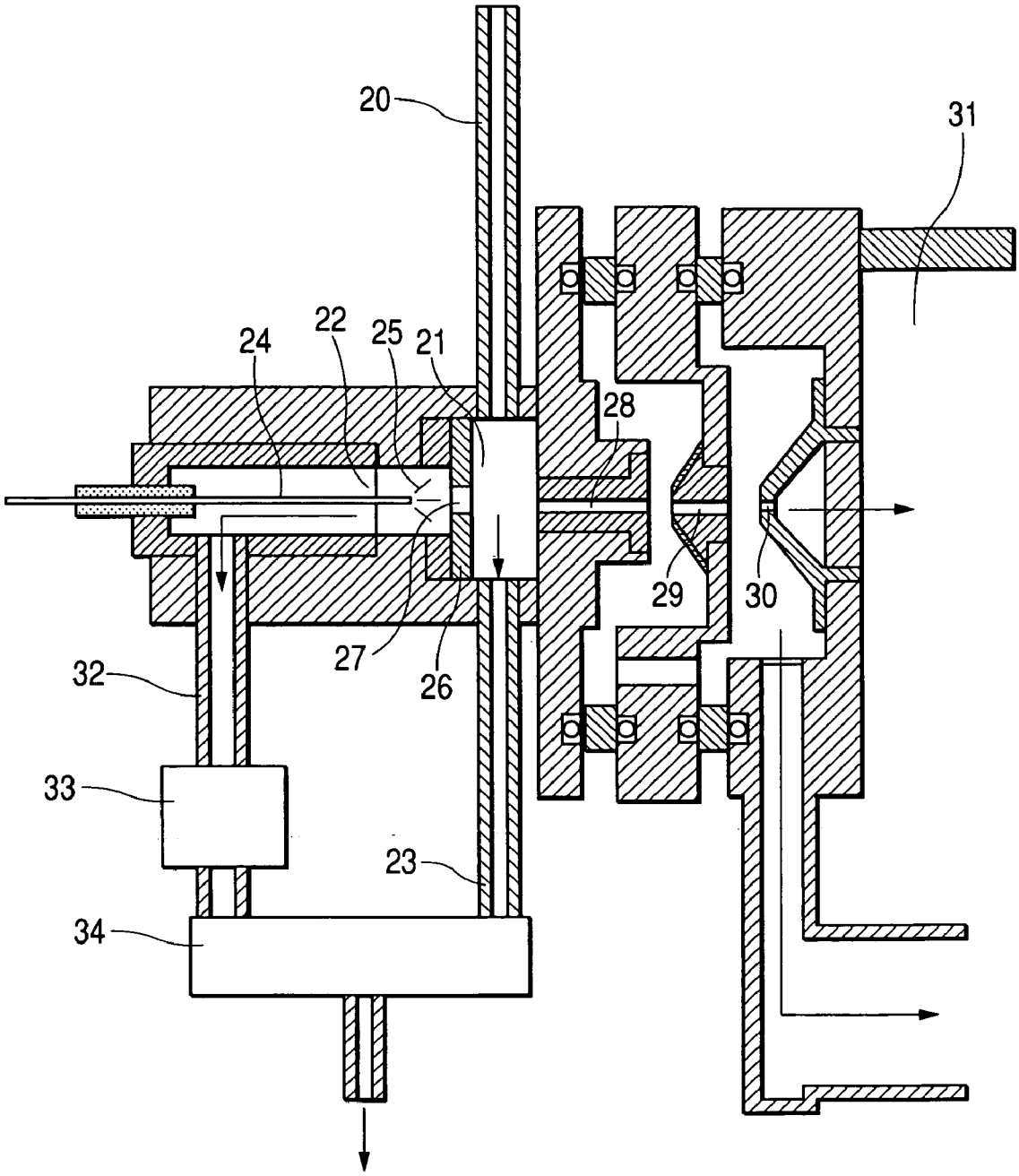
FIG. 11 PRIOR ART
FIG. 11 is a view of a conventional ion source in a detector using the mass analysis method.

FIG. 9 is a view showing an example of yet another ion source in an embodiment according to the present invention. The configuration shown in FIG. 9 is one formed by changing the planar repeller electrode 71 in the configuration shown in FIG. 3 to a cylindrical repeller electrode 71 having a collar at the tip. By this configuration, a gas 58 containing sample molecules is fed to an ion drift region 64 and discharge portions 59 and 67 through the hollow space of the cylinder of the repeller electrode 71. At both the positive discharge portion 59 and the negative discharge portion 67, the gas flows in the state of counter flow. Explanations are given hereunder focusing on the points that differ from those in the configuration shown in FIG. 3.

An introduction tube 36 is connected to a cylindrical repeller electrode 71 having a collar at the tip thereof via a joint 75 and a gas 58 is introduced through the introduction tube 36. Since a voltage is applied on the repeller electrode 71 by a repeller voltage power supply 72, in consideration of the insulation from the introduction tube 36, it is preferable to use an insulator of TEFLON® (registered trademark of DuPont) or similar material as the joint 75.

The gas having flown into an ion drift region 64 via the repeller electrode 71 flows through the openings 63 and 66 of the extraction electrodes (counter electrodes) 62 and 65 into the discharge portions 59 and 67. That is, the gas flow is in the state of counter flow at the positive discharge portion 59 and the negative discharge portion 67. The ions generated at the discharge portions 59 and 67 are introduced into the ion drift region 64 by electric fields, are introduced into a vacuum region through the aperture 42*a* of an aperture electrode 70*a*, and are subjected to mass analysis.

As shown in FIG. 9, the mutual relationship of the positions of the discharge portions 59 and 67, the extraction electrodes 65 and 62, and the aperture electrode 70*a* is maintained by a holder 73*a* formed by an insulator, and the mutual relationship of the positions of the discharge portions 59 and 67, the extraction electrodes 65 and 62, and the repeller electrode 71 is maintained by a holder 73*b* formed by an insulator.

In an ion source such as that in this embodiment of the present invention, by feeding the gas 58 containing sample molecules along a simple path without the use of a complicated piping system, ionization is accomplished by corona discharge and positive and negative ions are generated substantially at the same time. Therefore, the loss in a small amount of sample gas can be reduced.

A mass spectrometric apparatus using an ion source according to an embodiment of the present invention makes it possible to measure the mass spectrum of positive ions and the mass spectrum of negative ions during a short period of time and detect various kinds of chemical substances substantially at the same time. For example, by displaying the mass spectrum of positive ions and the mass spectrum of negative ions by different colors on a display, it becomes possible to analyze the mass spectra in an integrated manner.

A mass spectrometric apparatus in an embodiment according to the present invention may also be effectively used on regular basis for the detection of substances which affect the environment, for example, toxic substances in a combustion gas, dioxin precursors, toxic hazardous materials buried underground and the like.

The above explanations have been provided on the basis of a mass spectrometric apparatus that uses a quadrupole ion trap mass spectrometer as the exemplary mass analysis portion 40. However, even when a quadrupole mass spectrometer or a time-of-flight mass spectrometer is used as the mass analysis portion 40, the effects described herein are equally valid. Further, an ion source according to the present invention can be connected to an ion mobility spectrometer, a drift tube, or any similar device capable of the time-of-flight measurement of ions in atmospheric air or a decompressed region.

A mass spectrometric apparatus according to the present invention makes it possible to detect various kinds of chemical substances substantially at the same time. Therefore, it is well suited for the improvement of the security of important facilities such as an airport.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. A mass spectrometric apparatus comprising:

an inlet through which a sample gas is introduced;

an ion source to generate ions of said introduced sample gas; and a mass spectrometer to analyze the mass of the ions generated at said ion source, wherein said ion source comprises a positive corona discharge portion to generate positive ions of said sample gas introduced through said inlet, a negative corona discharge portion to generate negative ions of said sample gas, and a vent through which said sample gas having passed through said negative corona discharge portion is ejected.

2. The mass spectrometric apparatus according to claim 1, wherein the sample gas in said negative corona discharge portion has previously passed through said positive corona discharge portion.

3. The mass spectrometric apparatus according to claim 2, further comprising:

a repeller electrode to impose a control voltage in order to select the polarity of ions to be detected with said mass spectrometer.

4. The mass spectrometric apparatus according to claim 2, wherein said positive and negative discharge portions include first and second needle electrodes, respectively.

5. The mass spectrometric apparatus according to claim 1, further comprising:

an ion drift region;

a first needle electrode disposed within said positive corona discharge portion on which voltage is applied in order to generate positive ions of said sample gas;

a first counter electrode having a first opening disposed between said positive corona discharge portion and said drift region;

a second needle electrode disposed within said negative corona discharge portion on which voltage is applied in order to generate negative ions of said sample gas; and a second counter electrode having a second opening disposed between said negative corona discharge portion and said drift region.

6. The mass spectrometric apparatus according to claim 5, wherein the sample gas in said negative corona discharge portion has previously passed through said positive corona discharge portion.

7. The mass spectrometric apparatus according to claim 6, wherein a straight line connecting a tip of said first needle electrode and a center of said first opening and a straight line connecting a center of said second opening and a tip of said second needle electrode are collinear.

8. The mass spectrometric apparatus according to claim 6, wherein an angle formed between a straight line connecting a tip of said first needle electrode and a center of said first opening and a straight line connecting a center of said second opening and a tip of said second needle electrode is in the range from approximately 90 to 120 degrees.

9. The mass spectrometric apparatus according to claim 5, further comprising:

a second vent through which said sample gas having passed through said positive corona discharge portion is ejected, wherein a straight line connecting a tip of said first needle electrode and a center of said first opening and a straight line connecting a center of said second opening and a tip of said second needle electrode are collinear, and further wherein said inlet through which said sample gas is introduced is disposed toward a space between said positive corona discharge portion and said negative corona discharge portion.

10. The mass spectrometric apparatus according to claim 1, further comprising:

a second vent through which said sample gas having passed through said positive corona discharge portion is ejected, and wherein said inlet through which said sample gas is introduced is disposed toward a space between said positive corona discharge portion and said negative corona discharge portion.

11. An ion source comprising:

an inlet through which a sample gas is introduced;

a positive corona discharge portion having a first needle electrode on which voltage is applied in order to generate positive ions of said sample gas introduced through said inlet;

a negative corona discharge portion having a second needle electrode on which voltage is applied in order to generate negative ions of said sample gas; and a vent through which said sample gas having passed through said negative corona discharge portion is ejected.

12. The ion source according to claim 11, wherein the sample gas in said negative corona discharge portion has previously passed through said positive corona discharge portion.

13. The ion source according to claim 12, further comprising:

a drift region;

a first counter electrode having a first opening disposed opposite the tip of said first needle electrode, said first counter electrode disposed between said positive corona discharge portion and said drift region; and a second counter electrode having a second opening disposed opposite the tip of said second needle electrode, said second counter electrode disposed between said negative corona discharge portion and said drift region.

14. The ion source according to claim 13, wherein a straight line connecting a tip of said first needle electrode and a center of said first opening and a straight line connecting a center of said second opening and a tip of said second needle electrode are collinear.

15. The ion source according to claim 13, wherein an angle formed between a straight line connecting a tip of said first needle electrode and a center of said first opening and a straight line connecting a center of said second opening and a tip of said second needle electrode is in the range from approximately 90 to 120 degrees.

16. The ion source according to claim 13, further comprising:

a second vent through which said sample gas having passed through said positive corona discharge portion is ejected, wherein a straight line connecting a tip of said first needle electrode and a center of said first opening and a straight line connecting a center of said second opening and a tip of said second needle electrode are collinear, and further wherein said inlet through which said sample gas is introduced is disposed toward a space between said positive corona discharge portion and said negative corona discharge portion.

17. The ion source according to claim 11, further comprising:

a second vent through which said sample gas having passed through said positive corona discharge portion is ejected, and wherein said inlet through which said sample gas is introduced is disposed toward a space between said positive corona discharge portion and said negative corona discharge portion.

18. A mass analysis method, comprising the steps of:

feeding a sample gas to a positive corona discharge portion;

generating positive ions of said sample gas by corona discharge at said positive corona discharge portion;

feeding said sample gas having passed through said positive corona discharge portion to a negative corona discharge portion;

generating negative ions of said sample gas by corona discharge at said negative corona discharge portion;

selecting the polarity of the ions to be subjected to mass analysis; and applying mass analysis to said ions the polarity of which has been selected.

19. The method of claim 18, further comprising the step of:

based on said polarity selection, engaging a repeller electrode to drift ions of said selected polarity toward a means for carrying out said mass analysis.

20. The method of claim 19, further comprising the step of:

displaying the mass analysis results as a mass spectrum.

* * * * *